US007350996B2

(12) United States Patent
Bielecki et al.

(10) Patent No.: US 7,350,996 B2
(45) Date of Patent: Apr. 1, 2008

(54) RETRACTABLE WRITING UTENSIL

(75) Inventors: Andrew Bielecki, Evanston, IL (US); Matthew J. Gerules, Chicago, IL (US)

(73) Assignee: Sanford, L.P., Oak Brook, IL (US)

( * ) Notice: Subject to any disclaimer, the term of this patent is extended or adjusted under 35 U.S.C. 154(b) by 420 days.

(21) Appl. No.: 11/091,219

(22) Filed: Mar. 28, 2005

(65) Prior Publication Data

US 2006/0216103 A1 Sep. 28, 2006

(51) Int. Cl.
*B43K 24/02* (2006.01)

(52) U.S. Cl. ..... 401/108; 401/107; 401/110

(58) Field of Classification Search ..... 401/107–112
See application file for complete search history.

(56) References Cited

U.S. PATENT DOCUMENTS

| | | | | |
|---|---|---|---|---|
| 3,813,176 | A | 5/1974 | Kamo | |
| 3,941,488 | A | 3/1976 | Maxwell | |
| 3,985,455 | A | 10/1976 | Wahlberg | |
| 4,022,535 | A | 5/1977 | Ritter | |
| 4,221,490 | A | 9/1980 | Malm | |
| 4,315,695 | A | 2/1982 | Alves dos Santos et al. | |
| 4,459,056 | A * | 7/1984 | Getgey et al. | 401/50 |
| 4,533,271 | A | 8/1985 | Sansevero | |
| 4,549,827 | A | 10/1985 | Mack | |
| 4,759,650 | A | 7/1988 | Granoff | |
| 4,815,881 | A | 3/1989 | Chern | |
| 4,904,101 | A | 2/1990 | Petterson | |
| 5,015,111 | A | 5/1991 | Petterson | |
| 5,048,990 | A | 9/1991 | Hashimoto et al. | |
| D324,542 | S | 3/1992 | Lin | |
| 5,174,814 | A | 12/1992 | Burwell et al. | |
| 5,184,908 | A | 2/1993 | Yamamoto et al. | |
| 5,342,135 | A | 8/1994 | Tucker | |

(Continued)

FOREIGN PATENT DOCUMENTS

DE 8806917 U1 11/1989

(Continued)

OTHER PUBLICATIONS

International Search Report corresponding to International Patent Application Serial No. PCT/US2006/011014, European Patent Office, dated Nov. 23, 2006, 2 pages.

(Continued)

*Primary Examiner*—David J. Walczak
(74) *Attorney, Agent, or Firm*—Marshall, Gerstein & Borun LLP

(57) ABSTRACT

A writing utensil having a distal end and a proximal end and extending generally along a longitudinal axis includes a casing having a slot extending generally along the longitudinal axis adjacent the proximal end, an eraser disposed on the proximal end of the casing, a valve coupled to the casing adjacent the distal end and including a valve door, a writing tip movable between a stored position in which the tip is stored within the valve and a writing position in which the tip extends out of the valve, and an actuator disposed in and slidable in the slot and operatively coupled to the writing tip such that movement of the actuator in the slot moves the writing tip between the stored position and the writing position.

20 Claims, 6 Drawing Sheets

U.S. PATENT DOCUMENTS

| | | | | |
|---|---|---|---|---|
| 5,599,122 | A | | 2/1997 | Yu |
| D400,581 | S | | 11/1998 | Hasegawa |
| 5,855,442 | A | | 1/1999 | Keller |
| 5,871,294 | A | | 2/1999 | Turner |
| 5,915,867 | A | | 6/1999 | Hashimoto |
| 5,927,881 | A | | 7/1999 | Yang |
| 5,947,624 | A | * | 9/1999 | Davignon ..... 401/202 |
| 5,957,603 | A | | 9/1999 | Bell |
| D417,206 | S | | 11/1999 | Hirota |
| 6,019,535 | A | | 2/2000 | Turner |
| 6,033,141 | A | | 3/2000 | Blaustein et al. |
| 6,048,121 | A | | 4/2000 | Carver |
| 6,106,179 | A | | 8/2000 | Kuo |
| 6,120,204 | A | | 9/2000 | Rigoni |
| D446,213 | S | | 8/2001 | Chen et al. |
| 6,347,898 | B1 | | 2/2002 | Rhodes et al. |
| 6,371,673 | B1 | | 4/2002 | Gueret |
| D457,185 | S | | 5/2002 | Ham |
| D460,484 | S | | 7/2002 | Bianco, Jr. |
| D460,982 | S | | 7/2002 | Bianco, Jr. |
| 6,478,495 | B2 | | 11/2002 | Ami et al. |
| 6,505,984 | B2 | | 1/2003 | Smith et al. |
| D471,233 | S | | 3/2003 | Geiselhart et al. |
| D472,578 | S | | 4/2003 | Plantz et al. |
| 6,540,422 | B2 | | 4/2003 | Torii |
| 6,554,516 | B1 | | 4/2003 | Christopher |
| 6,554,517 | B2 | | 4/2003 | Ahmed |
| 6,565,275 | B2 | | 5/2003 | Brand et al. |
| 6,588,958 | B1 | | 7/2003 | Seidler |
| D487,113 | S | | 2/2004 | Kent |
| D489,087 | S | | 4/2004 | Kent |
| 6,755,584 | B2 | | 6/2004 | O'Brien et al. |
| D497,180 | S | | 10/2004 | Cetera |
| D497,387 | S | | 10/2004 | Cetera |
| D501,509 | S | | 2/2005 | Lecce |
| 2002/0159817 | A1 | | 10/2002 | Brand et al. |
| 2002/0159818 | A1 | | 10/2002 | Smith et al. |
| 2003/0138283 | A1 | | 7/2003 | O'Brien et al. |
| 2003/0210945 | A1 | | 11/2003 | Noguchi |
| 2003/0210947 | A1 | | 11/2003 | Calendrille et al. |
| 2004/0037609 | A1 | | 2/2004 | Kageyama |
| 2004/0213627 | A1 | | 10/2004 | Marschand et al. |
| 2004/0265039 | A1 | | 12/2004 | Buck |
| 2005/0079003 | A1 | | 4/2005 | Buck et al. |

FOREIGN PATENT DOCUMENTS

| | | | |
|---|---|---|---|
| DE | 8900030 | U | 5/1990 |
| DE | 3341759 | A1 | 11/1997 |
| DE | 10326926 | A1 | 6/2003 |
| EP | 1 354 722 | A2 | 10/2003 |
| GB | 2 325 649 | A | 12/1998 |
| JP | 2003312185 | A | 11/2003 |
| JP | 2003312186 | A | 11/2003 |
| JP | 2003312188 | A | 11/2003 |
| KR | 2003056790 | A | 7/2003 |
| KR | 2003060260 | A | 7/2003 |
| KR | 2003061516 | A | 7/2003 |
| WO | WO-90/00118 | A1 | 1/1990 |
| WO | WO-03/068530 | A2 | 8/2003 |
| WO | WO 03/068530 | A2 | 8/2003 |

OTHER PUBLICATIONS

English language translation of DE-8900030U (Berendsohn AG).
English language translation of WO-9000118A1 (Baird).
Photograph A, Boone Marker, capped.
Photograph B, Boone Marker, uncapped.
Photograph C, Colorific Retractable Marker, retracted.
Photograph D, Colorific Retractable Marker, extended.
Photograph E, Marks-A-Lot Retractable Marker, retracted.
Photograph F, Marks-A-Lot Retractable Marker, extended.
Photograph G, Sharpie RT Marker, retracted.
Photograph H, Sharpie RT Marker, extended.
Photograph I, Tokai Retractable Marker, retracted.
Photograph J, Tokai Retractable Marker, extended.

* cited by examiner

FIG. 7
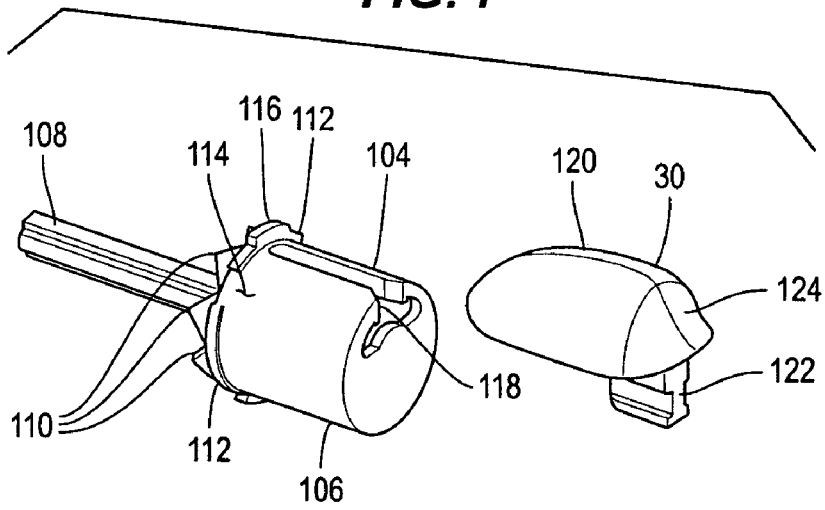
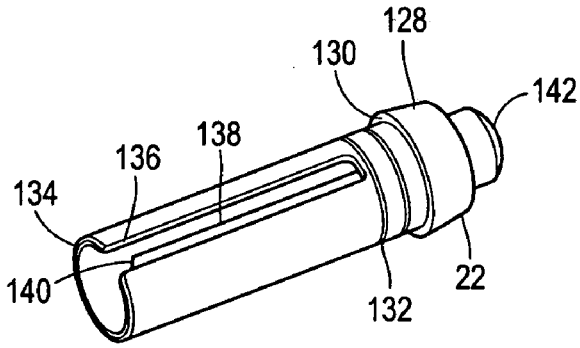
FIG. 8
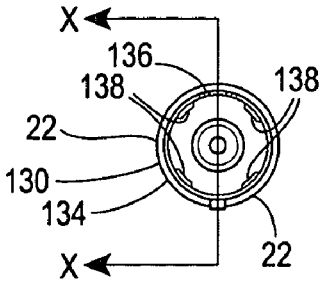
FIG. 9
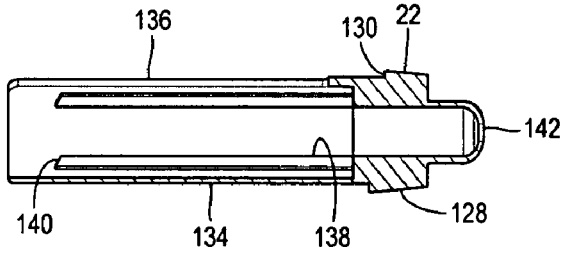
FIG. 10

RETRACTABLE WRITING UTENSIL

FIELD OF THE INVENTION

The invention relates generally to a retractable writing utensil with an eraser.

BACKGROUND OF THE INVENTION

Permanent and dry erase markers traditionally include a removable cap over the writing tip such that when the marker is not in use, the cap can be placed over the writing tip to keep the tip from drying out. This design can be ineffective, however, if the cap becomes lost during use and the user is not able to cap the tip. The uncapped marker quickly dries out. In addition, such caps are typically stored on a back end of the marker during use, and therefore they interfere with or prevent attachment of an eraser to the back end. Still further, such caps can be overly cumbersome to use.

To address this concern, several designs have recently become available in which the marker includes a sealing system so that the writing tip can be extended out through the sealing system into a writing position, and then retracted back into the sealing system when the user is finished. See, for example, U.S. Pat. No. 5,915,867. The user engages an actuator on the back side of the marker opposite the writing tip to move the tip between the positions. The writing tip is stored in a generally air tight compartment and does not dry out. While such sealing systems eliminate the need for a cap, the actuator is again located on the back end of the marker, and therefore prevents application of an eraser in this location.

The prior art, however, fails to consider a dry erase marker and the advantages that would accrue with an integrated eraser. As is known, a dry erase marker uses an ink that, when deposited on a particular surface, can be easily wiped from that surface. Such eraser would be most conveniently located on the back end of the marker, but for the caps or actuators of the prior art. It would therefore be advantageous to incorporate an eraser on a retractable pen for dry erase ink.

BRIEF DESCRIPTION OF THE DRAWINGS

FIG. 7 is an enlarged, exploded perspective view of a plunger and actuator provided with the writing utensil of FIG. 1.

FIG. 8 is an enlarged perspective view of a plug provided with the writing utensil of FIG. 1.

FIG. 9 is an end view of the plug disclosed in FIG. 8.

FIG. 10 is a cross-sectional view of the plug taken along line X-X in FIG. 9.

Figure 1:
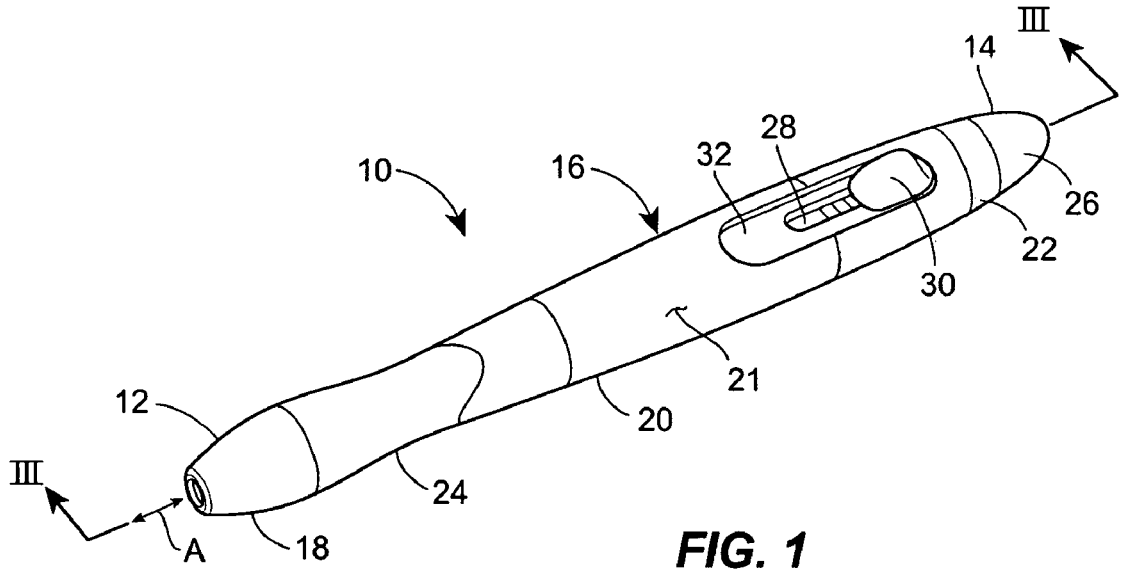
FIG. 1 is a perspective view of a writing utensil with a writing tip in a stored position.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Figure 2:
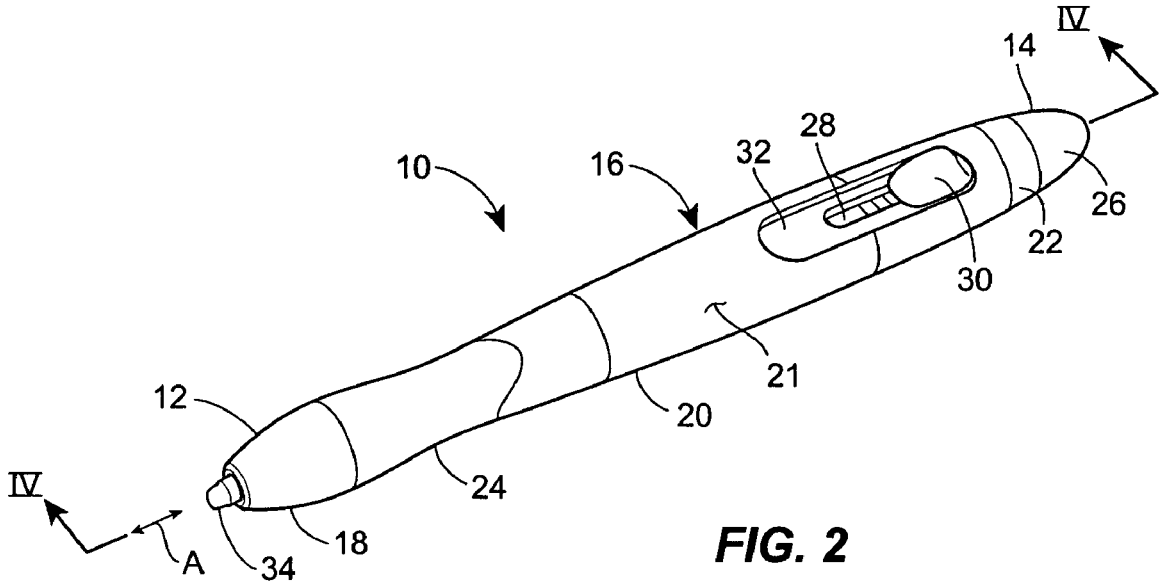
FIG. 2 is a perspective view of the writing utensil of FIG. 1 with the writing tip in a writing position.

Referring now to the drawings, and specifically to FIGS. 1 and 2, a writing utensil 10 is disclosed with a distal end 12 and a proximal end 14 disposed along a longitudinal axis A. The writing utensil 10 includes an outer shell or casing 16. The casing 16 includes a nose 18 attached to a barrel 20 at the distal end 12 of the writing utensil 10, and a plug 22 attached to the barrel 20 at the proximal end 14 of the writing utensil 10. The barrel 20 is generally contoured in an economic manner and has a sidewall 21. A barrel grip 24 can be disposed over the barrel 20 for improved cushioning, comfort, and grip. The barrel grip 24 can be made from TAPE or other similar materials. An eraser 26 is disposed on the plug 22 at the proximal end 14 of the writing utensil 10. The barrel 20 includes a slot 28 extending therethrough and aligned substantially parallel to the longitudinal axis A. An actuator 30 is slidably disposed in the slot 28. While the barrel 20 is generally circular in cross section, the barrel 20 includes a surface 32 on which the actuator slides 30. In this example, the surface 32 is recessed with regard to the sidewall 21 and is arcuate in profile. As will be described herein, the actuator 30 can be used to move the writing utensil 10 between a writing position shown in FIG. 2, in which a writing tip 34 extends out from the nose 18, and a stored position, in which the writing tip 34 is stored inside the nose 18 in a generally air tight condition.

Figure 3:
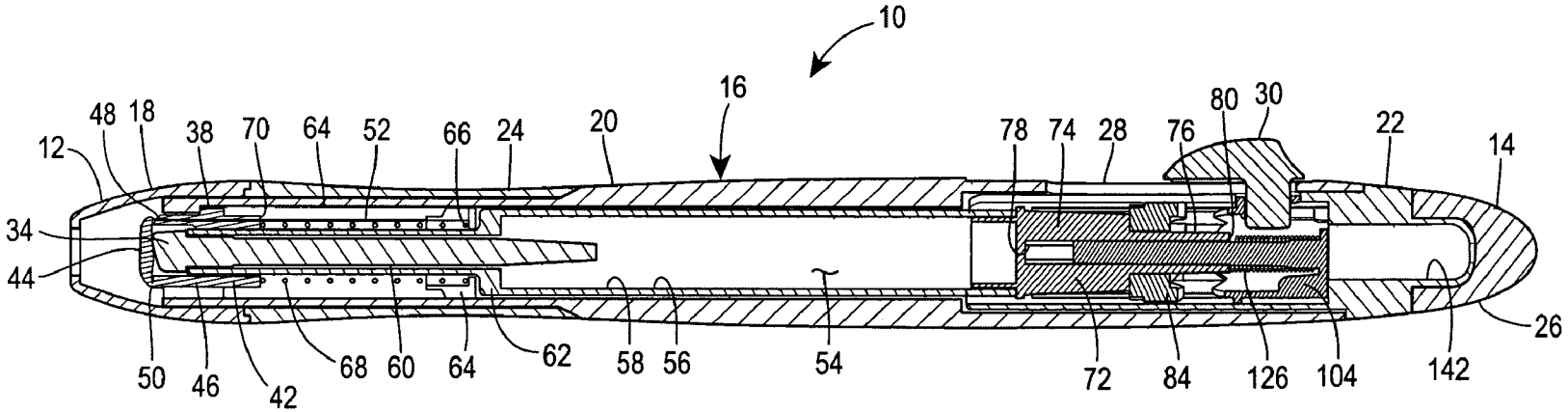
FIG. 3 is a cross-sectional view taken along line III-III of the writing utensil of FIG. 1.
Figure 4:
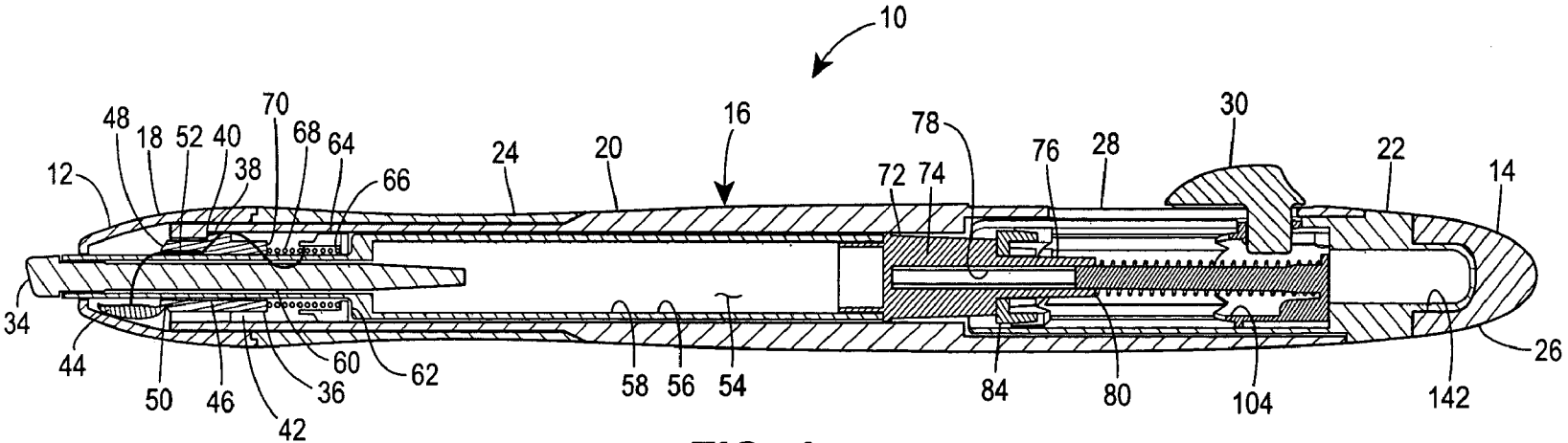
FIG. 4 is a cross-sectional view taken along line IV-IV of the writing utensil of FIG. 2.
Figure 5:
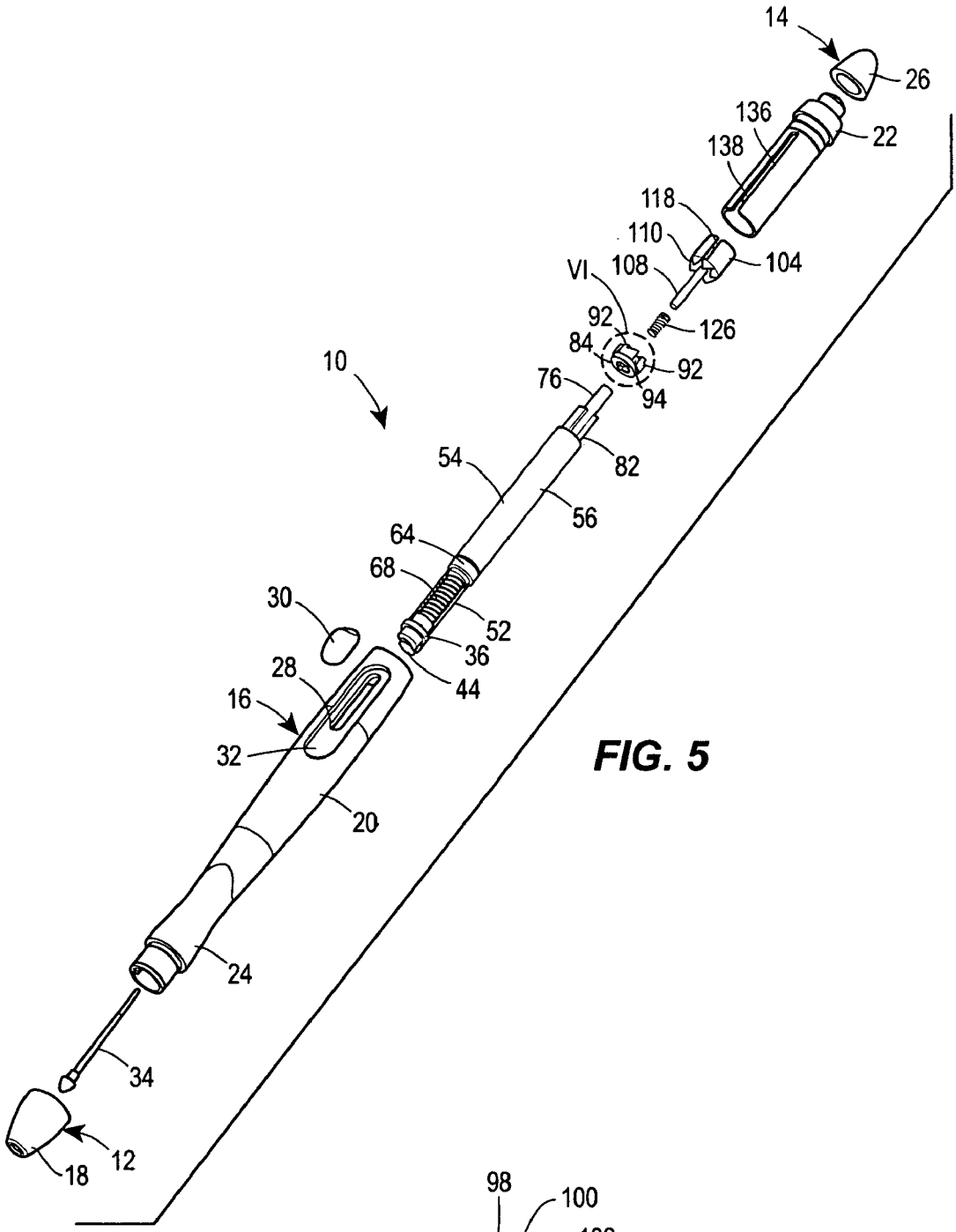
FIG. 5 is an exploded perspective view of the writing utensil of FIG. 1.

Referring now to FIGS. 3-5, a valve 36 for retaining the writing tip in a sealed enclosure when not is use is affixed to and disposed inside the distal end 12 of the casing 16. In this example the valve 36 is affixed to the distal end 12 of the barrel 20. The barrel 20 includes a groove 38 on its internal surface, and the valve 36 includes a shoulder 40 that is seated in the groove 38. Other structure can be used to secure the valve 36 with the barrel 20, such as pins, bonding agents, combinations thereof, or the like.

The valve 36 includes a valve body 42, a valve door 44, and an inner passage 46 along and through which the writing tip 34 may travel as it is being extended or retracted. The valve door 44 bears against a seat 48 of the valve body 42 in a closed position when the writing tip 34 is in the stored position shown in FIG. 3, and rotates outward to an open position to allow the writing tip 34 to extend out the nose 18 when the writing utensil 10 is in the writing position, as shown in FIG. 4. When the valve door 44 is in the closed position, the valve 36 provides a substantially air tight seal to ensure that moisture remains in the writing tip 34. The valve door 44 is attached to the valve body 42 at a hinge 50 that biases the valve door 44 to the open position. The valve door 44 may also be pushed to the open position by the writing tip 34 as the writing utensil 10 is moved into the writing position. The valve door 44 is maintained in the closed position by a string 52 connected to the valve door 44 as will be outlined herein.

The writing tip 34 is connected to a reservoir 54 that contains the ink. As is known, the ink flows from the reservoir 54 through the writing tip 34 and onto the writing surface when the writing utensil 10 is being used. A reservoir holder 56 holds the reservoir 54 and the writing tip 34. The reservoir holder 56 is slidable within the casing 16 to allow the writing tip 34 to be slid between the writing position and the stored position. The reservoir holder 56 includes a reservoir chamber 58 which holds the reservoir 54 and a reservoir neck 60 which holds the writing tip 34. The reservoir chamber 58 and the reservoir neck 60 meet at a reservoir shoulder 62.

When the writing tip 34 is in the stored position, the writing tip 34 is contained in the valve body 42. The writing tip 34 is substantially sealed in the inner passage 46 on one end by the valve door 44 and is sealed on the opposite end by the engagement of the reservoir neck 60 against the inner passage 46.

A spring collet 64 is disposed against the reservoir shoulder 62. The spring collet 64 is formed as a cylinder that surrounds, but is spaced from, the reservoir neck 60 and includes a spring face 66 against which a valve spring 68 bears. The cylindrical shape encloses one end of the valve spring 68 to ensure that the end of the spring 68 is maintained on the spring collet 64. The valve spring 68 also bears against a rear face 70 of the valve body 42. The valve spring 68 biases the reservoir holder 56 away from the valve 36 to urge the writing utensil 10 toward the stored position.

The string 52 is connected at a first end to the spring collet 64, loops around the valve door 44, and is connected at a second end to the spring collet 64. When the writing utensil 10 is in the stored position and the reservoir holder 56 is maintained away from the valve 36, the string 52 is tensioned and pulls the valve door 44 tightly against the valve seat 48. When the writing utensil 10 is placed in the writing position and the reservoir holder 56 is pushed towards the valve 36, the string 52 becomes slack and the valve door 44 is opened by the bias of the hinge 50, the force of the writing tip 34, the string 52, or all. The stiffness of the string 52 in compression can provide some force in opening the valve door 44.

A refill cap 72 is coupled to the proximal end of the reservoir holder 56 and includes a body 74 that seals the proximal end of reservoir holder 56. The refill cap 72 has a refill tube 76 extending from the body 74 away from the reservoir holder 56. The refill tube 76 has a socketed inner surface 78 and a rear bearing surface 80. In this example, the socketed inner surface 78 has four lobes. The refill cap 72 also includes a set of ribs 82 extending radially outward from the refill tube 76.

Figure 6:
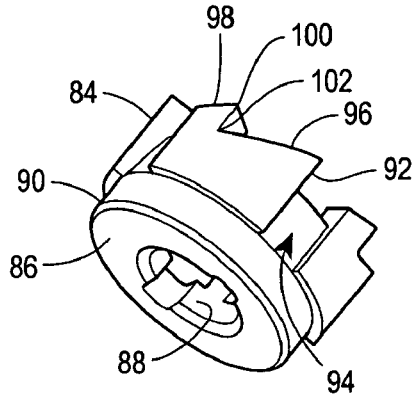
FIG. 6 is an enlarged detail view of a ratchet taken from circle VI in FIG. 5.

Referring to FIGS. 5 and 6, a ratchet 84 is adapted for insertion over the refill tube 76. Accordingly, the ratchet 84 includes a circular plate 86 with a hole 88 in the center and an outer cylindrical surface 90. The hole 88 is sized for insertion over the refill tube 76 so that the plate 86 bears against the refill ribs 82. The ratchet 84 is rotatable relative to the refill cap 72, and includes a series of four ratchet teeth 92 extending upward from the plate 86. The matched teeth 92 also extend outward relative to the outer cylindrical surface 90 of the plate 86. The four ratchet teeth 92 are evenly spaced around the ratchet 84 and are separated by four ratchet notches 94. Each ratchet tooth 92 includes a first angled bearing surface 96, a second angled bearing surface 98, a peak 100, and a valley 102. As will be seen, the ratchet 84 is used to move the writing utensil 10 between the writing position and the stored position.

Referring now to FIGS. 5 and 7, the actuator 30 and a plunger 104 are depicted. The plunger 104 includes a body 106 and a shaft 108 extending away from the body 106. The shaft 108 is sized for slidable insertion in the tube 76 of the refill cap 72 and is keyed to mate with the lobed interior 78 of the refill tube 76 so that reservoir holder 56 cannot rotate relative to the plunger 104. A set of eight teeth 110 extend away from the body 106 toward the ratchet 84 and are evenly spaced about the plunger 104. A set of four tabs 112 extend radially outward from the body 106 and also are disposed evenly around the surface of the body 106. The middle of each tab 112 is aligned between two plunger teeth 110, and a gap 114 between each tab 112 aligned between the two plunger teeth 110. One of the tabs 112 includes a nub 116 extending outward that engages the plug 22, as will be seen. A receiving channel 118 is disposed in the body 106 and is aligned with the nub 116.

The actuator 30 includes an actuator body 120 and an actuator tab 122 extending away from the body 120. The tab 122 is sized for insertion into the receiving channel 118 of the plunger 104. The actuator 30 includes an engagement surface 124 generally crosswise to axis A. The actuator body 120 is sized to allow a user to engage the actuator 30 and move the actuator 30 along a path substantially parallel to axis A to move the writing utensil 10 between the stored position and the writing position, as will be specifically described below.

As can be seen in FIG. 5, an actuator spring 126 is placed over the plunger shaft 108 and bears against the rear face 80 of the refill tube 76 at one end and the plunger 104 on the other so as to bias the plunger 104 and actuator 30 away from the reservoir holder 56. The actuator spring 126 exerts a lesser force than the valve spring 68 so that the force of the valve spring 68 can overcome the force of the actuator spring 126 and push the reservoir holder 56 toward the distal end 12, thereby compressing the actuator spring 126 as seen in FIG. 3.

Referring now to FIGS. 5 and 8-10, the plug 22 is shown in greater detail. The plug 22 includes a plug body 128 with a shoulder 130 and a set of ribs 132. The shoulder 130 bears against the rear end of the barrel 20, and the ribs 132 engage ribs in the barrel 20 (not shown) to securely locate the plug 22 relative to the barrel 20. The plug 22 includes a cylinder 134 extending away from the plug body 128 that has a slot 136 open on the distal end. A series of four ribs 138 extend inwardly on the inner surface of the cylinder 134. The ribs 138 are evenly spaced about the plug 22 and each has an angled tip 140. The plunger 104 slides axially within the plug 22, and both the actuator tab 122 and the nub 116 of the plunger 104 slide within the slot 136 in the plug 22 so the plunger 104 and the actuator 30 do not rotate relative to the plug 22. The plunger 104 slides in the plug 22 so each gap 114 in the plunger 104 slides over each rib 138 in the plug 22. The plug 22 includes a projection 142 on the proximal end 14 of the plug body 128.

The eraser 26 is fastened to the proximal end 14 of the plug 22. In this instance, the eraser 26 is bonded to the projection 142. Any bonding agent known in the art to bond the selected eraser 26 to the plug 22 can be used. Here, because the writing utensil 10 is shown to include a dry-erase ink, the eraser 26 can be any open cell or closed cell polymer foam known to remove dry erase ink from a dry erase marking surface. In another use, such as for a mechanical pencil, the eraser 26 may be rubber or other substance known to erase pencil lead. Further, the eraser 26 may be attached to the plug 22 or casing 16 in other manners. As is known, a pencil lead eraser is generally contained in ferrule at the end of the pencil. Erasers used for mechanical drafting can be retractable within a housing. Other methods or structure known or that will be known to attach an eraser to a writing utensil are within the scope of this disclosure.

Figure 11A:
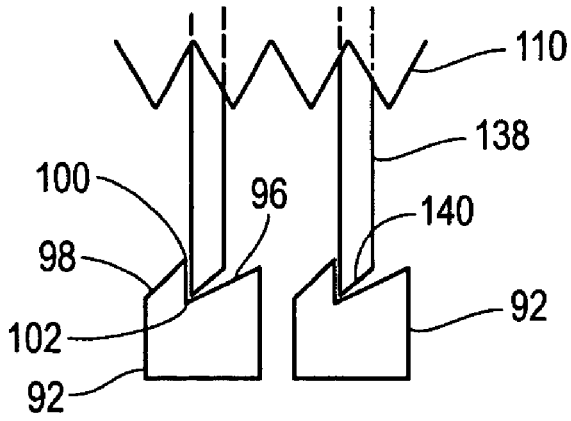
FIGS. 11*a*-11*f* are detail views depicting the interaction of the plug, actuator, and ratchet as the writing utensil is moved between the stored position and the writing position.

Referring now to FIGS. 11*a*-11*f*, a depiction of the ratchet teeth 92, the plunger teeth 110, and the plug ribs 138 are shown as if they were unrolled onto a flat surface and looking from the inside of the writing utensil 10 out. In FIG. 11*a*, the ratchet teeth 92 are disposed on the angled ends 140 of the plug ribs 138. The ratchet teeth 92 are forced against the ribs 138 on the plug 22 by the force of the valve spring 68. In this position, the ratchet 84 is held in a position towards the distal end 12 of the writing utensil 10, with the writing tip 34 out of the casing 16 and the writing utensil 10 in the writing position as shown in FIG. 4. The plunger 104 has been moved back to the proximal end 14 by the force of the actuator spring 126.

Figure 11B:
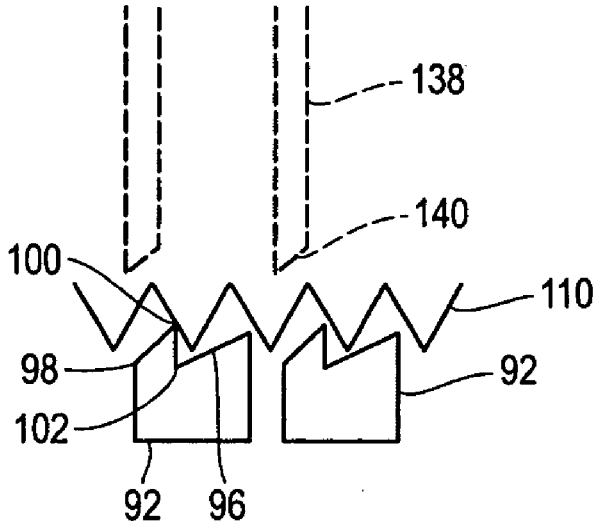
Figure 11C:
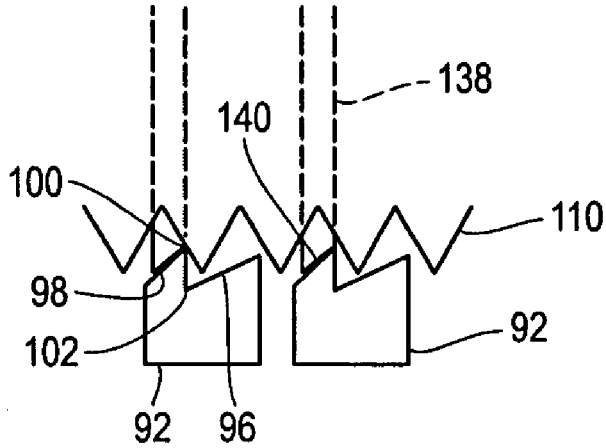

To move the writing utensil 10 to the stored position, the user pushes the actuator 30 toward the distal end 12 against the force of the actuator spring 126 and the valve spring 68. The plunger 104 moves axially toward the distal end 12 and the plunger teeth 110 engage the first angled bearing surface 96 of the ratchet teeth 92. As the plunger 104 continues to move distally, the ratchet 84 is moved completely out of contact with the ribs 138 of the plug 22. The ratchet 84, due to the force of the springs, rotates approximately 1/16 of a turn such that the first angled surface 96 slide upward across the plunger teeth 110 until the plunger teeth 110 are disposed against the peaks 100 of the ratchet teeth 92. This position is seen in FIG. 11*b*.

Figure 11D:
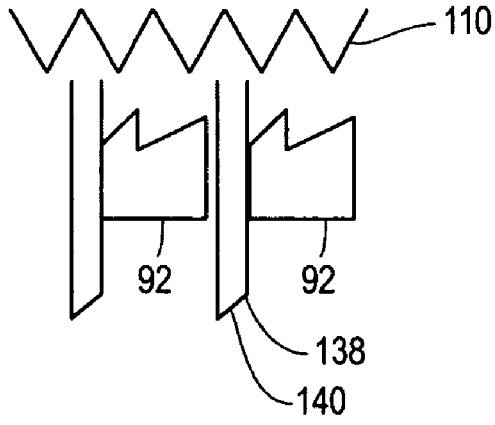

The user then releases the pressure on the actuator 30, and the plunger 104 begins to slide back to the proximal end 14 under the force of the valve spring 68. As the ratchet 84 slides backward, the second bearing surface 98 engages the angled end 140 of the ribs 138 of the plug 22. See FIG. 11*c*. The angled ends 140 of the ribs 138 force the ratchet teeth 92 to slide along the angled ends 140 and rotate another 1/16 of a turn so that each ratchet tooth 92 slides between the plug ribs 138. The reservoir holder 56 is pushed toward the proximal end 14 by the valve spring 68 until the spring seat 64 has moved far enough away from the valve 36 so that the string 52 pulls the valve door 44 against valve seat 48 of the valve body 42 and restricts any further movement of the reservoir holder 56. This is depicted in FIG. 11*d*. The writing utensil 10 is now in the stored position.

Figure 11E:
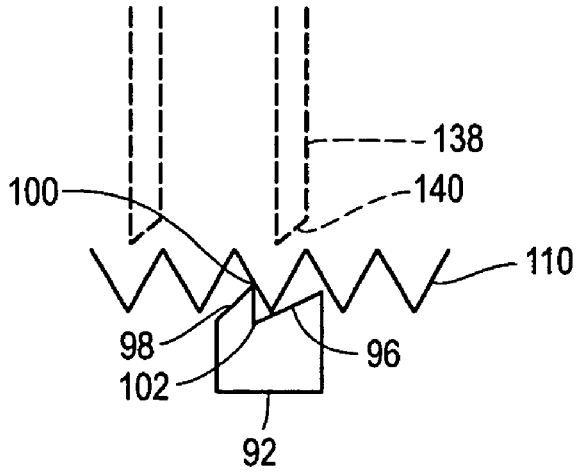
Figure 11F:
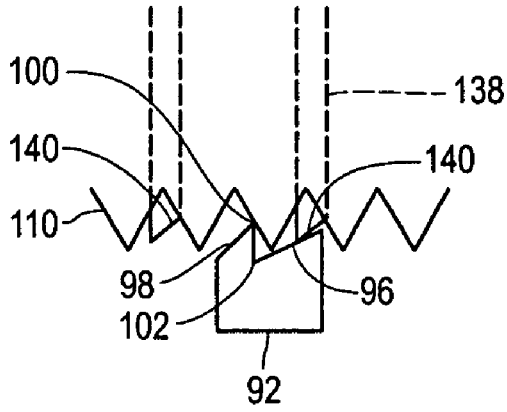

To move the writing utensil 10 back into the writing position, the user engages the actuator 30 and pushes it toward the distal end 12. This pushes the plunger 104 forward so that the plunger teeth 110 engage the first bearing surfaces 96 on the ratchet teeth 92 and moves the ratchet 84 toward the distal end 12. Once the ratchet 84 has been moved past the ribs 138 on the plug 22, the ratchet 84, under force from the two springs 84, 126, rotates 1/16 turn by the ratchet teeth 92 sliding along the plunger teeth 110 until the plug teeth 110 bear against the peaks 100 of the ratchet teeth 92. This position is depicted in FIG. 11*e*.

The user then releases the actuator 30 and allows the plunger 104 to move back toward the proximal end 14 under the force of the two springs 84, 126. As the plunger 104 moves backward, the angled ends 140 of the ribs 138 engage the first bearing surface 96 of the ratchet 84. See FIG. 11*f*. As the plunger 104 returns to the distal end 12, the ratchet 84 is rotated another 1/16 of a turn until the valleys 102 of the ratchet teeth 92 engage the angled ends 140 of the ribs 138. This position is depicted in FIG. 11*a*.

The writing utensil described herein allows for a dry erase marker to include an actuator to move a writing tip between a writing position and a generally sealed stored position as well as incorporating an integrated eraser. Such a writing utensil has the benefit of providing a cap less writing instrument that also includes an eraser on the body of the writing instrument. The foregoing description is not intended to limit the scope of the invention to the precise form disclosed. It is contemplated that various changes and modifications may be made by those skilled in the art without departing from the spirit and scope of the invention.

We claim:

1. A writing utensil with a distal end and a proximal end and extending generally along a longitudinal axis, comprising:

a casing having a slot extending generally along the longitudinal axis adjacent the proximal end;

a valve coupled to the casing adjacent the distal end and including a valve door;

a writing tip movable between a stored position in which the tip is stored in a generally air tight manner within the valve and a writing position in which the tip extends out of the valve;

an actuator disposed in and slidable along the slot and operatively coupled to the writing tip such that movement of the actuator in the slot moves the writing tip between the stored position and the writing position; and a reservoir holder slidably disposed within the casing and a string operatively coupling the valve door and the reservoir holder, wherein when the reservoir holder is moved towards the proximal end, the writing utensil is in the stored position and the string pulls the valve door closed.

2. The writing utensil of claim 1, wherein the casing comprises a barrel, a nose, and a plug, the nose attached to the distal end of the barrel, and the plug attached to the proximal end of the barrel.

3. The writing utensil of claim 2, wherein the plug includes a projection, the eraser being affixed to the projection.

4. The writing utensil of claim 2, wherein the slot is disposed in the barrel.

5. The writing utensil of claim 4, wherein the plug extends inside the barrel and includes a slot coordinated with the slot in the barrel.

6. The writing utensil of claim 2, further comprising a reservoir holder slidably disposed within the casing and a reservoir inside the reservoir holder, the writing tip connected to the reservoir.

7. The writing utensil of claim 6, further comprising a ratchet with a set of teeth disposed on the proximal end of the reservoir holder, the plug including a set of ribs extending toward the distal end, the ratchet teeth engaged with the ribs when the writing tip is in the writing position.

8. The writing utensil of claim 7, wherein the ratchet teeth are disposed between the ribs when the writing utensil is in the stored position.

9. The writing utensil of claim 1, further comprising a plunger disposed within the casing, the actuator being operatively connected to the plunger.

10. The writing utensil of claim 1, wherein the actuator includes an engagement surface generally cross-wise to the longitudinal axis.

11. The writing utensil of claim 1, wherein the casing includes a projection on the proximal end, and the eraser is affixed to the projection.

12. The writing utensil of claim 1, wherein the eraser is made from an open cell or a closed cell polymer.

13. A writing utensil with a distal end and a proximal end and extending generally along a longitudinal axis, comprising:

a casing having a sidewall and a slot extending along the sidewall and generally along the longitudinal axis adjacent the proximal end, the casing also including a plurality of ribs on its internal surface near the proximal end;

a valve coupled to the casing adjacent the distal end and including a valve door;

a writing tip movable between a stored position in which the tip is stored within the valve and a writing position in which the tip extends out of the valve;

a reservoir holder slidably disposed in the casing and holding the writing tip;

a ratchet rotatably disposed on a reservoir holder and including ratchet teeth;

an actuator disposed in and slidable in the slot in the casing, the actuator including an engagement surface engageable in the direction of the longitudinal axis; and a plunger slidably disposed inside the casing and operatively coupled to the actuator;

the plunger configured with the ratchet such that movement of the actuator along the longitudinal axis toward the distal end alternately moves the writing tip between the stored position in which the ratchet teeth are between the ribs and the writing position in which the ratchet teeth are disposed on ends of the ribs.

14. The writing utensil of claim 13, further comprising an eraser disposed on the proximal end of the casing.

15. The writing utensil of claim 14, wherein the casing includes a projection on the proximal end, and the eraser is affixed to the projection.

16. The writing utensil of claim 14, wherein the eraser is made from an open cell or a closed cell polymer foam.

17. The writing utensil of claim 13, further comprising a string operatively coupled from the valve door to the reservoir holder, wherein when the reservoir holder is moved towards the proximal end, the writing utensil is in the stored position and the string pulls the valve door closed.

18. The writing utensil of claim 13, wherein the casing comprises a barrel, a nose, and a plug, the nose being attached to the distal end of the barrel, and the plug being attached to the proximal end of the barrel, wherein the barrel includes the slot.

19. A writing utensil with a distal end and a proximal end and extending generally along a longitudinal axis, comprising:

a casing having a sidewall and a slot extending along the sidewall and generally along the longitudinal axis adjacent the proximal end;

an eraser disposed on the proximal end of the casing;

a valve coupled to the casing adjacent the distal end and including a valve door, a valve body and an inner passage;

a reservoir holder disposed in the casing and slidable substantially along the longitudinal axis and containing a reservoir;

a writing tip connected to the reservoir and movable with the reservoir holder between a stored position in which the tip is stored in a generally air tight manner within the valve and a writing position in which the tip is extended through the inner passage and outside of the valve body;

an actuator disposed in and slidable along the slot and operatively coupled to the writing tip such that movement of the actuator in the slot moves the writing tip between the stored position and the writing position, the actuator having an engagement surface engageable in the direction of the longitudinal axis; and a string coupling the valve door to the reservoir holder such that when the reservoir holder is in the stored position, the string maintains the valve door is a closed position.

20. The writing utensil of claim 1 further comprising an eraser disposed on the proximal end of the casing.

* * * * *

UNITED STATES PATENT AND TRADEMARK OFFICE

CERTIFICATE OF CORRECTION

PATENT NO. : 7,350,996 B2
APPLICATION NO. : 11/091219
DATED : April 1, 2008
INVENTOR(S) : Andrew Bielecki et al.

It is certified that error appears in the above-identified patent and that said Letters Patent is hereby corrected as shown below:

At Col. 2, line 27, "TAPE" should be -- TPE --.

Signed and Sealed this
Twenty-sixth Day of April, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,350,996 B2
APPLICATION NO. : 11/091219
DATED : April 1, 2008
INVENTOR(S) : Andrew Bielecki et al.

It is certified that error appears in the above-identified patent and that said Letters Patent is hereby corrected as shown below:

At Col. 3, line 59, "The matched teeth" should be -- The ratchet teeth --.

Signed and Sealed this
Eighteenth Day of October, 2011

David J. Kappos

David J. Kappos
*Director of the United States Patent and Trademark Office*